United States Patent [19]

Hiramatsu et al.

[11] 4,237,109

[45] Dec. 2, 1980

[54] PROCESS FOR PRODUCING CARBON FABRIC

[75] Inventors: Toru Hiramatsu; Ken-ichi Morita, both of Ehime, Japan

[73] Assignee: Toray Industries, Inc., Tokyo, Japan

[21] Appl. No.: 102,577

[22] Filed: Dec. 11, 1979

Related U.S. Application Data

[63] Continuation-in-part of Ser. No. 040,398, May 18, 1978, abandoned, which is a continuation of Ser. No. 834,307, Sep. 9, 1977, abandoned.

[30] Foreign Application Priority Data

Dec. 17, 1976 [GB] United Kingdom ..... 52915/76

[51] Int. Cl.[3] ..... D01F 9/22

[52] U.S. Cl. ..... 423/447.5; 264/29.2; 423/447.4; 423/447.6

[58] Field of Search ..... 423/447.5, 447.1, 447.4, 423/447.6, 447.7, 447.8; 264/29.2

[56] References Cited

U.S. PATENT DOCUMENTS

| | | | |
|---|---|---|---|
| 3,285,696 | 11/1966 | Tsunoda | 423/447.6 |
| 3,497,318 | 2/1970 | Noss | 423/447.5 |
| 4,069,297 | 1/1978 | Saito et al. | 423/447.6 |

FOREIGN PATENT DOCUMENTS

| | | | |
|---|---|---|---|
| 49-527 | 1/1974 | Japan | 423/447.4 |
| 47-26974 | 7/1972 | Japan | 423/447.5 |

*Primary Examiner*—Edward J. Meros

*Attorney, Agent, or Firm*—Finnegan, Henderson, Farabow, Garrett & Dunner

[57] ABSTRACT

Provided is a process for producing a carbon fabric composed of carbon fibers having improved tensile strength and modulus of elasticity from a precursor fabric made of an acrylonitrile polymer fiber. The acrylonitrile polymer fiber used has a fusing temperature of at least 310° C., contains not more than 0.1 wt. % of a residual solvent, and is prepared by a process wherein an acrylonitrile polymer comprised of at least 94 wt. % of acrylonitrile and not more than 6 wt. % of another comonomer and having an intrinsic viscosity of 1.4–2.3 is spun into filaments and then the filaments are stretched at a total stretching ratio of at least 6. The fiber of the fabric woven therefrom is treated with a transition metal-containing compound. The precursor fabric exhibits a free areal shrinkage of not more than 50% and has a weight per unit area falling within the specified range. The precursor fabric is heated in an oxidizing gas atmosphere at 200°–400° C. under conditions such that the fabric is permitted to shrink by at least 80% of the free areal shrinkage, and then, carbonized at at least 700° C. in a non-oxidizing atmosphere.

11 Claims, No Drawings

PROCESS FOR PRODUCING CARBON FABRIC

RELATED APPLICATION

This application is a continuation-in-part application of U.S. Ser. No. 40,398, filed May 18, 1979, which is a continuation application of U.S. Ser. No. 834,307, filed Sept. 19, 1977, both abandoned.

BACKGROUND OF THE INVENTION (1) Field of the Invention

This invention relates to a process for producing a carbon fabric having improved tenacity, elongation and modulus of elasticity.

(2) Description of the Prior Art

In general, a carbon fabric is manufactured by a process wherein a precursor fiber is heated at a temperature of from 200° to 400° C. in an oxidizing gas atmosphere thereby to be stabilized; then, the heat-treated fiber is carbonized at a temperature of at least 1,000° C. in a non-oxidizing gas atmosphere. Particularly, in order to produce a carbon fiber of improved tenacity and modulus of elasticity, it has been proposed that an acrylonitrile polymer fiber be employed as the precursor fiber and that the heat treatment of the acrylonitrile polymer fiber in an oxidizing gas atmosphere be carried out while tension is being applied to the acrylonitrile polymer fiber. However, this proposed technique involves the following problems. Mechanical properties of the final carbon fibers are liable to be not uniform due to possible slight variations in the tension applied to the precursor fibers during the heat treatment step. Occasionally, fibers have become fuzzy or broken during the heat treatment. Therefore, it would be necessary to strictly control the tension applied to the fibers and to use precursor fibers having uniform internal structure and physical properties.

Furthermore, when a fabric is used as the precursor instead of a fiber such as a filament or tow, the following problem occurs. It is difficult to apply a desired degree of uniform tension to fabrics during heat treatment; therefore, carbon fabrics thus treated will exhibit poor mechanical properties such as poor tenacity and modulus of elasticity.

U.S. Pat. No. 3,497,318 discloses a process for preparing carbon textiles wherein a thermoplastic polyacrylonitrile base textile material is subjected to a chemical oxidizing agent such as potassium permanganate, thereby to be converted into a thermoset polyacrylonitrile base textile material; and then, the thermoset polyacrylonitrile base textile material is carbonized. This reference specifically discloses the use of a yarn or fiber as the thermoplastic polyacrylonitrile base textile material, but does not specifically disclose a fabric. In this process, the oxidizing treatment by the chemical oxidizing agent is carried out with no tension being applied to the yarn or fiber, and hence, the finally resulting carbon fiber has poor mechanical properties. This is true even if a fabric is used instead of the yarn or fiber as the thermoplastic polyacrylonitrile base textile material.

U.S. Pat. No. 3,285,696 discloses a process wherein precursor acrylonitrile polymer fibers or fabrics are heated at a temperature of from 180° to 550° C. in an oxygen-containing atmosphere for a time sufficient to blacken the fibers or fabrics, and then, the blackened fibers or fabrics are carbonized. However, no special consideration is given to the precursor fibers or fabrics and, the heating conditions, other than the heating temperature and time. It is difficult to prepare carbon fabrics having satisfactory mechanical properties by this process.

U.S. Pat. No. 3,945,093 discloses a process wherein precursor polyacrylonitrile fabrics are heated under warp tension while restraining fill shrinkage by using a multiple roller unit. It is difficult, however, to apply uniform tension to the precursor fabrics, and therefore, the resulting carbon fabrics are undesirably hard and exhibit poor mechanical properties.

French Pat. No. 2,097,981 teaches that the heat oxidation treatment of precursor acrylonitrile copolymer fibers under tension, e.g. under a tension of 100 mg/denier, result in fibers which can be carbonized into carbon fibers of improved mechanical properties. However, even when precursor acrylonitrile copolymer fabrics are subjected to the heat oxidation treatment according to this teaching, the finally resulting carbon fabrics would be undesirably hard and exhibit poor mechanical properties.

Japanese Patent Publications No. 47-26,974 and Japanese Laid-open Patent Application No. 49-527 disclose the preparation of carbon fibers from precursor polyacrylonitrile fibers, but are completely silent on the preparation of carbon fabrics from precursor polyacrylonitrile fabrics.

SUMMARY OF THE INVENTION

A main object of the present invention is to provide a process whereby a carbon fabric having good and uniform mechanical properties such as tenacity, elongation, modulus of elasticity and pliability is advantageously produced, although the heat treatment in an active gas atmosphere of this intended process is carried out without applying any substantial tension to the precursor fabric, i.e., while free shrinkage of the precursor fabric is substantially permitted during the heat treatment. According to the process of the present invention, because the heat treatment is carried out without applying any substantial tension to the precursor fabric, the above-mentioned problems do not occur.

Other objects and advantages of the present invention will be apparent from the following description.

In accordance with the present invention, there is provided an improvement in a process for producing a carbon fiber wherein a precursor fabric of an acrylonitrile polymer fiber is heated in an oxidizing gas atmosphere maintained at a temperature of from 200° to 400° C., said gas being selected from the group consisting of air, nitric oxide, ozone and sulfur dioxide; and then, the fabric is carbonized in a non-oxidizing gas atmosphere maintained at a temperature of at least 700° C.

The improvement according to the present invention resides, first, in the precursor fabric to be heated in an oxidizing gas atmosphere, and secondly, in the fact that the heating of the precursor fabric is carried out under conditions such that the fabric is permitted to shrink by at least 80% of the free areal shrinkage. By the term "free areal shrinkage" herein used is meant the areal shrinkage which is determined by measuring the original area (A) of a fabric specimen before the heat treatment, and the area (B) of the fabric specimen after the fabric specimen is heated under a completely relaxed condition in an active gas atmosphere and at a temperature employed in the heat treatment mentioned hereinafter. The free areal shrinkage is calculated by the following formula:

Free areal shrinkage (%)=(A−B)/A×100

The fabric used as the precursor in the process of the invention is characterized by:

(i) exhibiting a free areal shrinkage of not more than 50%;

(ii) containing at least one transition metal or transition metal-containing compound selected from the group consisting of manganese, chromium, a manganese-containing compound and a chromium-containing compound;

(iii) being comprised of an acrylonitrile polymer fiber, which (a) has an intrinsic viscosity of from 1.4 to 2.3, (b) contains not more than 0.1%, based on the weight of the dry fiber, of a residual solvent, (c) has been drawn at a total drawing ratio of at least 6 based on its original length and (d) has a fusing temperature of at least 310° C.; and, (iv) having a weight per unit area, satisfying the formula:

$$50 \times \frac{C^{\frac{1}{2}}D^{1/1.6}(1-S)}{Y} \leqq E \leqq 300 \times \frac{C^{1/1.6}(1-S)}{Y}$$

wherein E is the weight per unit area (g/m$^2$) of the fabric,

C is the weave factor,

D is the average fineness in deniers, divided by 1000, of the bundle of fibers, used as the weft and warp for the formation of the fabric, S is the areal shrinkage of the fabric represented by the equation:

$$S=(S_1-S_2)/S_1$$

where $S_1$ and $S_2$ are areas of the fabric as determined before and after the oxidation and carbonization, respectively, and Y is the carbonization yield.

DESCRIPTION OF THE PREFERRED EMBODIMENTS

The precursor fabric used is comprised of an acrylonitrile polymer fiber. By the term "acrylonitirle polymer" used herein is meant polyacrylonitrile or an acrylonitirle copolymer comprised of, based on the weight of the copolymer, at least 94% by weight, preferably at least 97% by weight of acrylonitrile, and not more than 6% by weight, preferably not more than 3% by weight of at least one copolymerizable monoethylenically unsaturated monomer. Preferable copolymerizable monomers are those which are capable of accelerating the heat stabilization reaction of the acrylonitrile copolymer. Such copolymerizable monomers include, for example, acrylic acid, methacrylic acid, itaconic acid and salts of these acid such as alkali metal salts and ammonium salt, and 2-(1-hydroxyethyl)acrylonitrile and hydroxyethyl acrylate. In addition to these heat stabilization reaction-accelerating comonomers, other copolymerizable monoethylenically unsaturated monomers may be used, provided that the total amount of the comonomers other than acrylonitrile is not more than 6% by weight of the copolymer. For example, for the purpose of improving the spinnability and the filament-forming property of the polymer, lower alkyl esters of acrylic acid and methacrylic acid, and sulfonic acid group-containing monomer such as allylsulfonic acid, methallylsulfonic acid, styrenesulfonic acid and salts of these acids, acrylic amide, methacrylic amide, vinyl acetate and vinyl chloride may be used. When the amount of the comonomers other than acrylonitrile exceeds 6% by weight, the resulting polymer is liable to have poor packing and poor crystallinity, thus leading to a reduction in the fusing temperature ($T_f$) and to an increase in the shrinkage of the fibers.

The acrylonitrile polymer should possess an intrinsic viscosity of from 1.4 to 2.3 as determined at 25° C. on a solution of 150 mg of the polymer in 50 ml of dimethylformamide. The intrinsic viscosity is determined as follows. The polymer solution is prepared by dissolving 150 mg of a dry polymer specimen in 50 ml of dimethylformamide. The relative viscosity $\eta r$ of the polymer solution is measured at 25° C. in a thermostatic chamber by using an Ostwald viscometer. The specific viscosity $\eta sp$ is calculated from the relative viscosity $\eta r$ according to the equation:

$$\eta sp=\eta r-1.$$

Then, the intrinsic viscosity $[\eta]$ is calculated according to the equation:

$$[\eta] = (\sqrt{1 + 1.32\,\eta\,sp} - 1)/0.198.$$

It is difficult to obtain carbon fibers of the desired tensile strength and Young's modulus from low molecular weight acrylonitrile polymers having an intrinsic viscosity of below 1.4. In contrast, when the intrinsic viscosity is excessively high, the polymer exhibits poor spinnability and poor filament-forming property.

The acrylonitrile polymer fiber should have a fusing temperature ($T_f$) of at least 310° C. By the term "fusing temperature ($T_f$)" used herein is meant the temperature determined as follows. A bundle comprised of from 20 to 30 filaments is made into a double loop which has a peripheral length of about six times the distance between the two hooks of a metal wire frame. This double loop is placed around the two hooks of the metal wire frame, and ends of the bundle are tied to the frame with a fine metal wire. Then, the metal wire frame together with the double loop of filaments is placed into an oven maintained at a given temperature. After about five seconds, the metal wire frame is taken out from the oven and the bundle of filaments is checked to see if the filaments are broken or not. If the filaments are found to be unbroken, the above procedure is repeated at increasing temperatures until broken filaments are obtained. The final temperature at which the filaments are found to be broken is considered to be the "$T_f$" or the lowest fusing temperature.

When an acrylonitrile polymer fiber having a $T_f$ of lower than 310° C. is subjected to the heat oxidation treatment in an oxidizing gas atmosphere where shrinkage is permitted, the fiber exhibits an undesirable large shrinkage and the molecular configuration of the polymers tends to be greatly disordered, thus resulting in a carbon fiber with poor mechanical properties. In contrast, when the $T_f$ is excessively high, e.g., above approximately 380° C., the acrylontrile polymer fiber exhibits poor flexibility and flexural fatigue endurance; hence, it is rather difficult to weave the fiber into a fabric by using a conventional loom. The $T_f$ is preferably in the range of from 315° to 380° C., more preferably in the range of from 320° to 350° C.

The acrylonitrile polymer fiber used for the preparation of the precursor fabric is prepared as follows.

The procedure for preparing the acrylonitrile polymer is not particularly limited. Conventional polymerization procedures, for example, solution, suspension and emulsion polymerization procedures, may be employed.

The acrylonitrile polymer may be spun into fibers by using conventional wet, dry or half wet spinning procedures. For example, a wet spinning procedure may be employed wherein a spinning dope of the acrylonitrile polymer is extruded through orifices of a spinneret into a coagulating bath, and the filaments so formed are subjected to primary drawing, washing with water, drying for densifying the filaments, secondary drawing and then heat treatment. However, in this wet spinning procedure, the washing with water should preferable be carried out to an extent such that the amount of the residual solvent in the fiber is not larger than approximately 0.1% by weight based on the weight of the dry fiber. This is because the residual solvent functions as a plasticizer and, hence, lowers the $T_f$ of the fibers. When the amount of the residual solvent in the fiber exceeds approximately 0.1% by weight based on the weight of the dry fiber, a fabric woven therefrom cannot be satisfactorily subjected to the heat oxidation treatment. That is, in dividual fibers of the fabric are liable to stick to each other during the heat oxidation treatment. The above-mentioned drawing should preferably be carried out to an extent such that the total drawing ratio in the drawing steps is at least six times the original length of the fiber in order to obtain a fiber having high crystallinity and tenacity.

The acrylonitrile polymer fiber prepared by the above-mentioned procedure is then treated with a manganese-or chromium-containing compound for the incorporation of manganese, chromium or any of these metal-containing compounds in the precursor fabric. This treatment is crucial for obtaining a carbon fabric having the desired mechanical properties. That is, the carbon fabric obtained from the precursor fabric containing the above-mentioned metal or metal compound exhibits a high tenacity and a high modulus of elasticity, even though the precursor fabric is heated in an oxidizing gas atmosphere where shrinkage is permitted. The above-mentioned treatment may be applied to the fabric made from the acrylonitrile polymer fiber, instead of being applied to the acrylonitrile polymer fiber. The treatment is carried out usually by applying an aqueous solution of a particular manganese-or chromium-containing compound to the fiber or fabric, followed by drying. Preferable compounds used are potassium permanganate, sodium permanganate, potassium dichromate and sodium dichromate. Of these, potassium permanganate is most preferable.

It is preferable that these compounds be applied to the fiber or fabric in the form of an aqueous solution having a concentration of from 0.5% to 10% by weight and maintained at a temperature of from 20° to 98° C., and further that approximately 0.2% to 1.5% by weight, expressed in terms of the weight of the chromium or manganese atom and based on the weight of the dry fiber or fabric, of the compound is deposited on the fiber or fabric. When the amount of the compound deposited is less than the above-mentioned lower limit, the final carbon fabric will not exhibit the desired tenacity and modulus of elasticity. In contrast, when the amount of the compound deposited on the fiber or fabric exceeds the above-mentioned upper limit, the acrylonitrile polymer fibers tend to be broken or become fuzzy during the steps of heat oxidation treatment and carbonization.

The application of the above-mentioned compound may be effected by known procedures, for example, by immersing the fiber or fabric in an aqueous solution of the above-mentioned compound or by atomizing or spraying the aqueous solution onto the fiber or fabric.

In order to obtain a uniform deposition of the above-mentioned compound onto the fiber or fabric, it is preferable to immerse the fiber or fabric in an aqueous solution containing 0.5% to 10% by weight of the above-mentioned compound and maintained at 20° to 98° C. Following the aqueous solution treatment, the fiber or fabric is washed with water and then dried.

The procedure by which the acrylonitrile polymer fiber is made into a fabric may be a conventional one. Preferable fabrics used as the precursor in the process of the invention are woven fabrics such as plain, twilled and satin fabrics, and braided, coded and stitched fabrics.

The precursor fabric should have a weight per unit area, satisfying the formula:

$$50 \times \frac{C^{\frac{1}{2}} \cdot D^{1/1.6}(1-S)}{Y} \leqq E \leqq 300 \times \frac{C^{1/1.6}(1-S)}{Y}$$

wherein E is the weight per unit area (g/m$^2$) of the fabric, C is the weave factor, D is the average fineness in deniers, divided by 1000, of the bundle of fibers, used as the weft and warp for the formation of the fabric, S is the areal shrinkage of the fabric represented by the equation:

$$S=(S_1-S_2)/S_1$$

where $S_1$ and $S_2$ are areas of the fabric as determined before and after the oxidation and carbonization, respectively, and Y is the carbonization yield.

The weave factor (C) used herein is determined from the equation:

$$C = \frac{\text{Number of yarns per unit weave}}{\text{Number of intersections per unit weave}}$$

By the term "unit weave" used herein is meant the minimum recurring unit of the weave construction of a woven fabric. The above-mentioned "number of yarns per unit weave" refers to the total number of the warp yarns and the weft yarns present in the unit weave, and the above-mentioned "number of intersections per unit weave" refers to the number of the intersections between the warp yarns and the weft yarns present in the unit weave. The weave factor (C) varies depending upon the particular weave construction of the fabric. For example, C=1 for a plain weave, C=1.5 for a 2/1 twill weave, C=2 for a 3/1 or 2/2 twill weave, C=2.5 for a 4/1 or 3/2 twill weave, and C=4 for an eight-harness satin weave.

The afore-said carbonization yield (Y) is determined according to the equation:

$$Y = \frac{\text{Weight of the fabric as measured after carbonization}}{\text{Weight of the fabric as measured after oxidation but before carbonization}}$$

When the weight per unit area (E) of the precursor fabric is smallr than $50 \times C^{1/2} \cdot D^{1/1.6}(1-S)/Y$, the fiber bundles (i.e., the warp yarns and the weft yarns) tend to slip during the heat oxidation treatment and the carbonization treatment. The resulting carbon fabric is not uniform and possesses a poor appearance. When a carbon fiber reinforced composite article is molded from the carbon fabric, the resulting composite article also possesses poor appearance and mechanical properties. Furthermore, the composite article is poor in degree of precision and liable to be distorted.

In contrast, when the weight per unit area of the precursor fabric is larger than $300 \times C^{1/1.6}(1-S)/Y$, large crimps are liable to develop in the fiber bundles during the heat oxidation treatment and the carbonization treatment. When a carbon fiber reinforced composite article is molded from the carbon fabric, so obtained, the resulting composite article contains carbon fiber bundles in a wevy form, and therefore, is poor in appearance, degree of precision and mechanical properties.

The precursor fabric should exhibit a free areal shrinkage of not larger than 50%, preferably not larger than 45%. When the fabric exhibits a free areal shrinkage of larger than 50%, an undesirably large shrinkage occurs during the heat oxidation treatment. As a result of this large shrinkage, the heat oxidation treatment is carried out with difficulty, and the obtained carbon fabric is not satisfactory in its tenacity and modulus of elasticity.

The precursor fabric containing a transition metal or transition metal-containing compound is heated in an oxidizing gas atmosphere at a temperature of approximately 200° to 400° C., preferably 200° to 350° C. The oxidizing gas used includes, for example, air, nitric oxide, sulfur dioxide and ozone.

It is essential that the above-mentioned heat oxidation treatment is effected under a condition such that shrinkage of the fabric is permitted. The extent of the shrinkage permitted during the heat oxidation treatment is at least 80% of the free areal shrinkage of the fabric. When a shrinkage of less than 80% of the free areal shrinkage is permitted or when no shrinkage is permitted, fibers of the fabric tend to fuse together, and the fabric is liable to be distorted during the heat oxidation treatment; hence, the final carbon fabric is poor in pliability and in uniformity of the mechanical properties.

No particular method is required to carry out the shrinkage of the fabric, and conventional methods and apparatuses may be employed. For example, the fabric may be placed on a belt or a net conveyor moving in an active gas atmosphere, or hung on a series of driving rollers moving in an active gas atmosphere.

The heat treated fabric is then carbonized in a inert gas atmosphere maintained at a temperature of at least 700° C., preferably at least 800° C. The inert gas used includes, for example, nitrogen, helium or argon. It is preferable that the fabric is carbonized without applying any substantial tension thereto, although some degree of tension may be applied thereto.

The carbonization may be followed by graphitization, which is usually effected by heating the carbonized fiber or fabric at a temperature of at least 2,000° C. in an inert gas atmosphere.

The invention will be further illustrated with reference to the following examples wherein % is by weight unless otherwise specified.

In the examples, the tensile strength and Young's modulus of the carbon fiber were determined as follows. The tensile test was carried out on single carbon fiber specimens at a grip distance of 20 mm and at a grip separation rate of 0.5 mm per minute. The breaking load and elongation were measured, and the tensile strength and Young's modulus were determined therefrom.

In the determination of the tensile strength and Young's modulus, when the degree of variability in denier between single fibers in the yarn is relatively small, the cross-sectional area of each single fiber may be calculated from the weight per unit length of the yarn, the specific gravity and the number of filaments in the yarn. In contrast, when the degree of variability in denier between single fibers in the yarn is relatively large, the cross-sectional area of each single fiber may conveniently be calculated by a vibration method from the natural frequency of a single fiber specimen used for the tensile test. Furthermore, the waveness of a single fiber specimen and the elongation of the tester element, particularly the load cell, should be suitably corrected.

The preparation of carbon fabric reinforced composite material specimens and the test for their mechanical properties were conducted as follows.

A carbon fabric was impregnated with an epoxy resin preparation (a mixture of 100 parts by weight of Epikote 828 supplied by Shell Chemical Co. and 5 parts by weight of monoethylamine of boron trifluoride). A plurality of the resin impregnated fabrics were placed one upon another in a mold. The fabrics were maintained at 40° C. under vacuum for two hours. Then, the fabrics were pressed at a pressure of 3 kg/cm$^2$ and maintained in the pressed state at 170° C. for three hours, thereby obtaining a carbon fabric reinforced epoxy resin composite plate having a thickness of about 1.6 mm and containing about 70% of carbon fibers. The composite plate was cut into strip specimens of 150 mm in length and 6.0 mm in width so that the longitudinal direction of each specimen was in agreement with the direction of the warp or weft yarns of the fabrics. Four aluminum strips of 45 mm in length, 1 mm in thickness and 6 mm in width were adhered to both sides of the end portions of each strip specimen by using a binder ("Aron alpha" supplied by TOA GOSEI KAGAKU K.K.). The strip specimens, so prepared, were tested by using an Instrontensile tester (supplied by Shimazu Seisakusho K. K.) at a grip separation rate of 5 mm/min. The measured breaking load was divided by the cross-sectional area of each specimen to obtain the tensile strength in kg/mm$^2$.

EXAMPLE 1

99.0 mol% of acrylonitrile, 0.5 mol% of 2-(1-hydroxyethyl) acrylonitrile and 0.5 mol% of sodium methallylsulfonate in a solution state were copolymerized in dimethylsulfoxide to form a copolymer having an intrinsic viscosity of 1.6. The copolymer solution was extruded into a coagulating liquid comprised of dimethylsulfoxide and water. The filaments so formed were subjected to stretching, to solvent removal therefrom, to drying for causing densification thereof and, then, to further stretching in steam, to obtain filaments of 2,100 total deniers (0.7 denier per filament). The total stretching ratio was determined to be 8 times the original length. The filaments contained 0.05% of the residual solvent, and had a $T_f$ of 330° C., a tensile strength of 5.0 g/d and an elongation of 14%.

The filaments were woven into a twilled fabric having a weight of 270 g/m$^2$. The twilled fabric was immersed in an aqueous 5% potassium permanganate solution at 90° C. for one minute, followed by washing with water and drying. The immersion-treated fabric contained 1.1% (expressed in terms of the weight of manganese) of oxides derived from potassium permanganate. Then, the immersion-treated fabric was heated on a net conveyor in hot air maintained at a temperature of from 200° to 260° C. for about 150 minutes without applying any tension thereto. During this heat treatment, the fabric exhibited an areal shrinkage of 45%. Then, the fabric was heated to 1,400° C. in a nitrogen atmosphere to obtain a carbon fabric. The filament extracted from the carbon fabric had a tensile strength of 300 kg/mm$^2$ and a Young's modulus of 23 tons/mm$^2$.

For comparison purposes, a twilled fabric obtained in a manner similar to that described above was heat treated and carbonized by using a procedure similar to that described above. The filaments extracted from the final carbon fabric had a tensile strength of 240 kg/mm$^2$ and a Young's modulus of 23 tons/mm$^2$.

Furthermore, the above-mentioned immersion-treating procedure was repeated wherein an aqueous 0.3% potassium permanganate solution was used instead of the 5% solution, and the immersion period was changed to 30 minutes. The immersion-treated fabric contained 0.15% (expressed in terms of the weight of manganese) of oxides derived from the potassium permanganate. Then, the fabric was heat treated and carbonized by using a procedure similar to that described above. The filaments extracted from the final carbon fabric had a tensile strength of 235 kg/mm$^2$ and a Young's modulus of 23 tons/mm$^2$. It will be seen that these values are approximately the same as those of the carbon filaments obtained without carrying out the immersion-treating process using the aqueous potassium permanganate solution.

Furthermore, the above-mentioned immersion-treating procedure was again repeated wherein an aqueous 12% potassium permanganate solution was used and the immersion period was one minute. The treated fabric contained 2.0% (expressed in terms of the weight of manganese) of oxides derived from the potassium permanganate. Then, the fabric was heat treated and carbonized in a similar manner. However, the fabric became fuzzy during the carbonization step.

EXAMPLE 2

Acrylonitrile copolymer filaments of several types were produced, in a manner similar to that described in Example 1, from comonomer mixtures each having a composition such that methyl acrylate was substituted for a part of acrylonitrile in the comonomer mixture composition of Example 1. The amounts of methyl acrylate used and the $T_f$ of the filaments are shown in Table I, below.

Following the procedure mentioned in Example 1, carbon fabrics were manufactured from the above-mentioned filaments. Tensile strengths of the carbon filaments extracted from the carbon fabrics are shown in Table I, below.

TABLE I

| Run No. | Amount of methylacrylate (mol.%) | Total amount of comonomers except for AN (wt.%) | $T_f$ (°C.) | Tensile strength (kg/mm$^2$) |
|---|---|---|---|---|
| Example 1 | 0 | 2.24 | 330 | 300 |
| 2 - 1 | 1.0 | 3.81 | 315 | 270 |
| 2 - 2 | 2.0 | 5.37 | 310 | 250 |
| 2 - 3 | 3.0 | 6.92 | 290 | 180 |
| 2 - 4 | 5.0 | 9.94 | 260 | 130 |

EXAMPLE 3

Four types of filaments, each type comprising 3,000 filaments altogether of 2,100 deniers, were prepared in manners similar to those described in Examples 1 and 2, wherein the proportion of methyl acrylate in the comonomer mixtures and the stretching and heat-treating conditions were varied so that the four types of filaments exhibited different shrinkages during the heat treatment.

Then, the filaments were immersed in an aqueous 5% potassium permanganate solution at 90° C., for one minute, followed by thoroughly washing with water and drying. The immersion-treated filaments contained approximately 1.0% (expressed in terms of the weight of manganese) of oxides derived from the potassium permanganate. Following the procedure described in Example 1, fabrics were manufactured from the above-mentioned four types of treated filaments. Then, the fabrics were treated on a net conveyor in hot air maintained at a temperature of from 200° to 260° C. for about 150 minutes without applying any tension thereto. Then, the fabrics were heated to 1,400° C. in a nitrogen atmosphere to obtain carbon fabrics.

The extent of areal shrinkage occurring during the heat oxidation treatment of the fabrics and the tensile strengths of the final carbon fabrics are shown in Table II, below.

TABLE II

| Run No. | Areal shrinkage (%) | Tensile strength of carbonized filament (kg/mm$^2$) |
|---|---|---|
| 3-1 | 38 | 300 |
| 3-2 | 44 | 310 |
| 3-3 | 49 | 260 |
| 3-4 | 58 | 190 |

EXAMPLE 4

Eight-harness satin fabrics having weft and warp densities, both densities being seven filaments yarns per centimeter, were woven from acrylonitrile copolymer filaments, produced in a manner similar to that described in Example 1, and were immersion-treated with an aqueous 5% potassium permanganate solution in a manner similar to that described in Example 3. The satin fabrics were heated in hot air maintained at a temperature of from 200° to 260° C. for about 150 minutes. During this treatment, different amounts of shrinkages were permitted to occur by binding the fabrics to metal frames. The treated fabrics were then heated to 1,400° C. in a nitrogen atmosphere to thereby obtain carbon fabrics. The areal shrinkages of the fabrics permitted to occur during the heat treating step, the proportions of the areal shrinkages to the free areal shrinkages, the tensile strengths of the filaments extracted from the final carbon fabrics and the pliability of the carbon fabrics are shown in Table III, below.

TABLE III

| Run No. | Areal shrinkage permitted (%) | Proportion of areal shrinkage to free areal shrinkage (%) | Tensile strength (kg/mm²) | Pliability |
|---|---|---|---|---|
| 4-1 | 24 | 51 | 210 | Poor |
| 4-2 | 33 | 70 | 230 | Fairly good |
| 4-3 | 38 | 81 | 280 | Good |
| 4-4 | 47 | 100 | 290 | Good |

EXAMPLE 5

99.0 mol% of acrylonitrile, 0.5 mol% of 2-(1-hydroxyethyl) acrylonitrile and 0.5 mol% of sodium methallylsulfonate in a solution state were copolymerized in dimethylsulfoxide and in the presence of azobisisobutyronitrile (polymerization catalyst) and n-dodecyl mercaptan (intrinsic viscosity modifier). The amount of the intrinsic viscosity modifier was varied to prepare various copolymer solutions, which copolymers had intrinsic viscosities of 1.22, 1.44, 1.60, 1.93, 2.25 and 2.50. The polymer concentration in each copolymer solution was adjusted to about 20%. The spinning dope so obtained was extruded into a coagulating liquid comprised of dimethylsulfoxide and water. The filaments so formed were subjected to stretching, to washing (solvent removal), to drying for causing densification thereof, and, then, to further stretching in steam, to obtain 2,100 filaments of 3,000 total deniers (0.7 denier per filament). The total stretching ratio was determined to be 8 times the original length. However, the filaments spun from the copolymer having an intrinsic viscosity of 2.50 were poor in a fiber-forming property, and hence, their total stretching ratio was about 5 times their original length. The filaments spun from the copolymer having an intrinsic viscosity of 2.25 were stretched at a total stretching ratio of about 7 times the original length.

The filaments were then immersed in an aqueous 5% potassium permanganate solution at 90° C. for one minute, followed by washing with water and drying. The treated filaments were woven into an eight-harness satin fabric having a weight of about 270 g/m². Then, the fabric was heated on a new conveyor in hot air maintained at a temperature of about 240° C. for about 180 minutes without applying any substantial tension thereto. Then, the fabric was heated to about 1,400° C. in a nitrogen atmosphere to obtain a carbon fabric. Tensile strength and Young's modulus of the filaments extracted from the carbon fabric are shown in Table IV, below.

TABLE IV

| No. | [η] | Total stretching ratio | Tf (°C.) | Tensile Strength (kg/mm²) | Young's modulus (ton/mm²) |
|---|---|---|---|---|---|
| 5-1 | 1.22 | 8 | 305 | 210 | 20.9 |
| 5-2 | 1.44 | 8 | 315 | 260 | 21.8 |
| 5-3 | 1.60 | 8 | 330 | 310 | 23.0 |
| 5-4 | 1.93 | 8 | 335 | 330 | 24.0 |
| 5-5 | 2.25 | 7 | 335 | 280 | 23.1 |
| 5-6 | 2.50 | 5 | 335 | 190 | 20.3 |

EXAMPLE 6

Following a procedure similar to that mentioned in Example 1, 2,100 filaments of 3,000 total deniers (0.7 denier per filament) were prepared. In this preparation, the extent to which the filaments were washed with water was varied so that the content of the residual solvent in the filaments was as shown in Table V, below. The filaments were then woven into a twilled fabric having a weight of 270 g/m². The twilled fabric was treated in a manner similar to that in Example 1 to obtain a carbon fabric. Tensile strength of the filaments extracted from the carbon fabric is shown in Table V, below.

TABLE V

| No. | Content of residual solvent in fiber (%) | Tf (°C.) | Tensile strength (kg/mm²) |
|---|---|---|---|
| 6-1 | 0.05 | 330 | 300 |
| 6-2 | 0.08 | 320 | 260 |
| 6-3 | 0.15 | 305 | 200 |

EXAMPLE 7

Following a procedure similar to that mentioned in Example 1, 1,000 filaments (1.0 denier per filament) were prepared. The filaments were immersed in an aqueous 5% $KMnO_4$ solution at 90° C. for one minute, followed by washing with water and drying. The treated filaments were woven into eight-harness satin fabrics having various weights shown in Table VI, below. Each fabric was subjected to a heat treatment and a carbonization treatment in a manner similar to that in Example 1.

A carbon fiber reinforced epoxy resin composite plate was prepared from the carbon fabric and tensile strength of the composite plate was tested. The test results are shown in Table VI, below.

The permissible weight per unit area of the precursor fabric, calculated according to the formula herein before mentioned, was in the range of from 72 to 511 g/m². The parameters used for this calculation were as follows: C=4 (for eight-harness satin weave), D=1, S=about 0.62 and Y=about 0.53.

TABLE VI

| No. | Weight per unit area of fabric (g/m²) | Tensile strength of composite plate (kg/mm²) |
|---|---|---|
| 7-1* | 45 | 45 |
| 7-2 | 95 | 78 |
| 7-3 | 340 | 57 |
| 7-4 | 440 | 50 |
| 7-5 | 555 | 28 |

*Composite plate of No. 7-1 was of a poor appearance because of yarn loosening or slippage in the carbon fabric.

EXAMPLE 8

Following a procedure similar to that mentioned in Example 7, 1,000 filaments (1.0 denier per filament) were prepared, and then, treated with $KMnO_4$. The treated filaments were woven into plain fabrics having various weights shown in Table VII, below. Each fabric was subjected to a heat treatment and a carbonization treatment in a manner similar to that in Example 1.

A carbon fiber reinforced epoxy resin composite plate was prepared from the carbon fabric and tensile strength of the composite plate was tested. The test results are shown in Table VII, below.

The permissible weight per unit area of the precursor fabric, calculated according to the formula herein before mentioned, was in the range of from 35 to 210 g/m². The parameters used for this calculation were as follows: C=1 (for plain weave), D=1, S=0.63 and Y=0.53.

TABLE VII

| No. | Weight per unit area of fabric ($g/m^2$) | Tensile strength of composite plate ($Kg/mm^2$) |
|---|---|---|
| 8-1* | 25 | 39 |
| 8-2 | 55 | 75 |
| 8-3 | 150 | 54 |
| 8-4 | 195 | 43 |
| 8-5 | 245 | 25 |

*Composite plate of No. 8-1 was of a poor appearance because of yarn loosening or slippage in the carbon fabric.

EXAMPLE 9

Following a procedure similar to that mentioned in Example 1, 6,000 filaments (1.0 denier per filament) were prepared. The filaments were immersed in an aqueous 5% $KMnO_4$ solution at 90° C. for one minute, followed by washing with water and drying. The treated filaments were woven into 4/4 twilled fabrics having various weights shown in Table VIII, below. Each fabric was subjected to a heat treatment and a carbonization treatment in a manner similar to that in Example 1.

A carbon fiber reinforced epoxy resin composite plate was prepared from the carbon fabric and tensile strength of the composite plate was tested. The test results are shown in Table VIII, below.

The permissible weight per unit area of the precursor fabric, calculated according to the formula herein before mentioned, was in the range of from 163 to 349 $g/m^2$. The parameters used for this calculation were as follows: C=4 (for 4/4 twill weave), D=6, S=0.60 and Y=0.53.

TABLE VIII

| No. | Weight per unit area of fabric ($g/m^2$) | Tensile strength of composite plate ($Kg/mm^2$) |
|---|---|---|
| 9-1* | 120 | 40 |
| 9-2 | 185 | 60 |
| 9-3 | 250 | 52 |
| 9-4 | 315 | 46 |
| 9-5 | 405 | 27 |

*Composite plate of No. 9-1 was of a poor appearance because of yarn loosening or slippage in the carbon fabric.

What we claim is:

1. An improvement in a process for producing a carbon fiber wherein a precursor fabric of an acrylonitrile polymer fiber is heated in an oxidizing gas atmosphere maintained at a temperature of from 200° to 400° C., said gas being selected from the group consisting of air, nitric oxide, ozone and sulfur dioxide; and then, the fabric is carbonized in a non-oxidizing gas atmosphere maintained at a temperature of at least 700° C.; said acrylonitrile polymer being polyacrylonitrile or a copolymer comprised of, based on the weight of the copolymer, at least 94% by weight of acrylonitrile and not more than 6% by weight of at least one other copolymerizable monoethylenically unsaturated monomer; the improvement comprising:

using, as the precursor fabric, a fabric (i) exhibiting a free areal shrinkage of no more than 50%, (ii) containing at least one transition metal or transition metal-containing compound selected from the group consisting of manganese, chromium, a manganese-containing compound and a chromium-containing compound, and (iii) being comprised of an acrylonitrile polymer fiber, which (a) has an intrinsic viscosity of from 1.4 to 2.3, (b) contains not more than 0.1%, based on the weight of the dry fiber, of a residual solvent, (c) has been drawn at a total drawing ratio of at least 6 based on its original length and (d) has a fusing temperature of at least 310° C.; and said fabric (iv) having a weight per unit area, satisfying the formula:

$$50 \times \frac{C^{1} \cdot D^{1/1.6}(1-S)}{Y} \leqq E \leqq 300 \times \frac{C^{1/1.6}(1-S)}{Y}$$

wherein E is weight per unit area ($g/m^2$) of the fabric, C is weave factor, D is average fineness in deniers, divided by 1000, of the bundle of fibers, used as the weft and warp for the formation of the fabric, S is areal shrinkage of the fabric represented by the equation:

$$S=(S_1-S_2)/S_1$$

where $S_1$ and $S_2$ are areas of the fabric as determined before and after the oxidation and carbonization, respectively, and Y is carbonization yield;

said improvement further comprising carrying out said heating of the precursor fabric under conditions such that the fabric is permitted to shrink by at least 80% of the free areal shrinkage.

2. A process according to claim 1 wherein said copolymer is comprised of, based on the weight of the copolymer, at least 97% by weight of acrylonitrile and not more than 3% by weight of at least one other copolymerizable monoethylenically unsaturated monomer.

3. A process according to claim 1 wherein the amount of the transition metal or transition metal-containing compound contained in the fabric is approximately 0.2% to 1.5% by weight expressed in terms of the weight of the transition metal atom and based on the weight of the dry fabric.

4. A process according to claim 1 wherein said fabric containing the transition metal or transition metal-containing compound is prepared by treating an acrylonitrile polymer fiber or a fabric made therefrom with the transition metal-containing compound.

5. A process according to claim 4 wheren the transition metal-containing compound used for the treatment is potassium permanganate.

6. A process according to claim 4 wherein the acrylonitrile polymer fiber or the fabric made therefrom is immersed in an aqueous solution containing 0.5% to 10% by weight of the transition metal-containing compound and maintained at a temperature of 20° to 98° C., and thereafter, the so treated fiber or fabric is washed and then dried.

7. A process according to claim 1 wherein said acrylonitrile polymer fiber has a fusing temperature of from 315° to 380° C.

8. A process according to claim 1 wherein said acrylonitrile polymer fiber has a fusing temperature of from 320° to 350° C.

9. A process according to claim 1 wherein said precursor fabric exhibits a free areal shrinkage of not more than 45%.

10. A process according to claim 1 wherein the precursor fabric is heated in the oxidizing gas atmosphere maintained at a temperature of from 200° to 350° C.

11. A process according to claim 1, wherein the resultaing carbon fabric is composed of carbon fibers having a tensile strength of at least 240 $kg/mm^2$.

* * * * *